US007898193B2

(12) United States Patent
Miller et al.

(10) Patent No.: US 7,898,193 B2
(45) Date of Patent: Mar. 1, 2011

(54) SLOT RESONANCE COUPLED STANDING WAVE LINEAR PARTICLE ACCELERATOR

(75) Inventors: Roger H. Miller, Mountain View, CA (US); Nikolai Barov, San Diego, CA (US)

(73) Assignee: Far-Tech, Inc., San Diego, CA (US)

( * ) Notice: Subject to any disclaimer, the term of this patent is extended or adjusted under 35 U.S.C. 154(b) by 394 days.

(21) Appl. No.: 12/152,883

(22) Filed: Jun. 4, 2008

(65) Prior Publication Data

US 2009/0302785 A1 Dec. 10, 2009

(51) Int. Cl.
*H05H 9/00* (2006.01)

(52) U.S. Cl. ..... 315/505; 315/5.41

(58) Field of Classification Search ..... 315/5.39, 315/5.41, 5.43, 39, 500, 505
See application file for complete search history.

(56) References Cited

U.S. PATENT DOCUMENTS

| | | | | |
|---|---|---|---|---|
| 2,966,610 | A | 12/1960 | Schmidt et al. | |
| 3,011,085 | A | 11/1961 | Caldwell | |
| 3,309,630 | A | 3/1967 | Hukunaga et al. | |
| 3,546,524 | A | 12/1970 | Stark | |
| 3,668,460 | A | 6/1972 | James | |
| 3,684,913 | A | 8/1972 | James et al. | |
| 3,953,758 | A | 4/1976 | Tran | |
| 3,989,978 | A | 11/1976 | Sauseng et al. | |
| 4,024,426 | A * | 5/1977 | Vaguine | 315/5.41 |
| 4,146,817 | A * | 3/1979 | McEuen et al. | 315/5.41 |
| 4,155,027 | A | 5/1979 | Schriber et al. | |
| 4,307,322 | A | 12/1981 | Chaffee et al. | |
| 4,425,529 | A * | 1/1984 | Leboutet | 315/5.41 |
| 4,746,833 | A | 5/1988 | King et al. | |
| 4,931,694 | A | 6/1990 | Symons et al. | |
| 4,988,919 | A * | 1/1991 | Tanabe et al. | 315/5.41 |
| 5,014,014 | A * | 5/1991 | Swenson | 315/505 |
| 5,227,701 | A | 7/1993 | McIntyre | |
| 5,332,947 | A | 7/1994 | Thiess et al. | |
| 5,469,022 | A | 11/1995 | Begum et al. | |
| 5,534,750 | A | 7/1996 | Thiess et al. | |
| 5,619,216 | A | 4/1997 | Park | |
| 5,811,943 | A * | 9/1998 | Mishin et al. | 315/505 |
| 6,593,695 | B2 | 7/2003 | Thiess | |
| 6,642,678 | B1 | 11/2003 | Allen et al. | |
| 7,262,566 | B2 * | 8/2007 | Pirozhenko et al. | 315/505 |

* cited by examiner

*Primary Examiner*—Thuy Vinh Tran
(74) *Attorney, Agent, or Firm*—William A. Eklund

(57) ABSTRACT

A slot resonance coupled, linear standing wave particle accelerator. The accelerator includes a series of resonant accelerator cavities positioned along a beam line, which are connected by resonant azimuthal slots formed in interior walls separating adjacent cavities. At least some of the slots are resonant at a frequency comparable to the resonant frequency of the cavities. The resonant slots are offset from the axis of the accelerator and have a major dimension extending in a direction transverse to the radial direction with respect to the accelerator axis. The off-axis resonant slots function to magnetically couple adjacent cavities of the accelerator while also advancing the phase difference between the standing wave in adjacent cavities by 180 degrees in addition to the 180 degree phase difference resulting from coupling of the standing wave in each cavity with the adjacent slot, such that the signals in each cavity are in phase with one another and each cavity functions as a live accelerating cavity. The resonance frequency of the slot is the comparable to the resonance frequency of the cavities, resulting in coupling of the cavities while also eliminating the need for side-cavity or other off-axis coupling cavities.

17 Claims, 8 Drawing Sheets

0 Mode $\pi/2$ Mode $\pi$ Mode

SLOT RESONANCE COUPLED STANDING WAVE LINEAR PARTICLE ACCELERATOR

BACKGROUND OF THE INVENTION

The invention disclosed and claimed herein is related to high energy linear charged particle accelerators of the kind used to accelerate protons, electrons or ions.

Linear particle accelerators are used to produce beams of electrically charged nuclear or atomic particles. Low energy linear particle accelerators include cathode ray tubes, x-ray generators, and other similar devices. High energy linear accelerators, known as linacs, are larger and more complex, typically ranging from approximately one meter to several kilometers in length.

Linear accelerators are used in medicine for radiotherapy purposes and in industry as testing electron accelerators and for other purposes. They are also used in high energy nuclear physics research. Proton accelerators, for example, are used as drivers for neutrino experiments and as spallation neutron sources, and are of potential use in driving and controlling sub-critical nuclear reactors. Another potential use of high energy accelerators is the transmutation of radioactive nuclear waste to benign nonradioactive elements.

A standing wave linear accelerator typically includes a series of resonant cavities positioned along a longitudinal axis that defines a beam line, which is the path of travel of the accelerated particles. The cavities are connected by beam tube segments, which may be integral with the cavities and which form a beam tube that opens into each cavity. The cavities and the beam tube segments are electrically conductive, generally being constructed of copper; and the entire beam line, including the beam tube segments and the cavities, is evacuated.

The cavities are coupled to a power source that introduces a radio frequency (RF) power signal into the cavities, typically a klystron that produces a power signal in the microwave frequency range, to establish and maintain a standing wave in the cavities. The standing microwave signal provides the alternating electrical fields that accelerate charged particles as they pass through each cavity.

As charged particles pass through the successive cavities along the beam line, some or all of the cavities provide additional acceleration of the particles. The particles are typically bunched so that they arrive at the accelerating cavities in phase with the sinusoidally varying electric fields in the cavities. The beam tube segments connecting the cavities act as a Faraday cage, such that no acceleration occurs within the beam tube segments. The combined acceleration of all of the cavities along the beam line results in the particles being accelerated to their maximum velocity and energy as they are emitted from the accelerator, which velocity may approach but not exceed the velocity of light The ratio of the velocity of an accelerated particle to the velocity of light is generally represented as $\beta$, where $\beta=v/c$, and in many applications a goal in designing an accelerator is to attain the highest value of $\beta$ as is feasible, given design and cost constraints.

Acceleration within a cavity is caused by the force of the resonating electric field component of the standing wave acting on the particles as they pass through the cavity. In order to achieve optimum acceleration of a particular kind of particle passing along the beam line, the sizes and shapes of the cavities, the spacing between cavities, and the phases of the resonant signals within the cavities at each point along the beam line, must all be selected so that the direction and amplitude of the resonating electric field in each cavity are timed to achieve maximum forward acceleration of the charged particles as they pass through the cavity. In this regard, successive cavities along the beam line are typically spaced apart by increasingly greater distances toward the emission end of the accelerator, such that the distance between any two adjacent cavities is the distance that a particle travels during ½ period, or one period, depending on the phase shift of the resonant standing wave from one cavity to the next at that point along the beam line.

Early standing wave accelerators, i.e., those constructed before the development of side-cavity coupled accelerators in the 1960's, were either "0-mode" or "$\pi$ mode" accelerators. The term "0-mode" has been most commonly used to mean that there is a 0° phase shift in the resonant RF signals from one cavity to the next. The term "$\pi$ mode" has been most commonly used to mean that there is a 180° phase shift from cavity to cavity. These alternatives were used because other modes have a shunt impedance that is smaller by a factor of two, and high shunt impedance is a measure of the efficiency of an accelerator. This is because the amplitudes of the fields in the cavities have a sinusoidal distribution and all cells have the same phase, so only the cells at the maximum of the sinusoidal distribution are optimally phased for acceleration of the particles. The cavities near the nodes are approximately 90° out of phase from the particles.

In the traditional $\pi/2$ mode, there is a 90° phase shift from cavity to cavity, such that half of the cavities are unexcited and thus do not effect any acceleration. Nevertheless, the problem with a 0 or $\pi$ mode structure is that the dispersion curve at both 0 and $\pi$ has a slope of zero, so the mode separation is very small. With a small mode separation a significant amount of the input power is dissipated by exciting the modes adjacent to the desired mode, which do not contribute to the acceleration of the particles. Furthermore, excitation of undesired modes disturbs the desired electric field pattern and changes the way the particles absorb energy, and thus disturb the synchronism between the particle beam and the standing waves.

The $\pi/2$ mode is desirable because its dispersion curve, which describes the phase advance per cavity as a function of the operating frequency, is steepest and it has the largest inter-mode spacing for a structure of a particular size. However, a standing wave accelerator must be constructed with a larger number of cavities if adjacent cavities are coupled with a $\pi/2$ phase advance, because in such an arrangement every other cavity is a "dead," or nonaccelerating, cavity. A primary solution to this problem has been to place the dead cavities off-axis, which results in what is known as a side-cavity coupled accelerator. While the dead off-axis cavities have little or no electromagnetic field, they nevertheless couple the on-axis accelerating cavities together. Side-cavity coupled accelerators, or any other cavity arrangement with a $\pi/2$ phase advance, have the advantage of a reduced sensitivity to construction tolerances. Also, such structures are phase-stabilized in the sense that RF losses do not bring about phase shifts between the accelerating cavities. Because of the symmetry associated with being in the middle of the pass band, the $\pi/2$ mode has significantly more relaxed tolerances than any other mode.

Most relatively recent proton accelerators have been constructed to include three stages positioned in sequence along the length of the accelerator: an initial radiofrequency quadrupole (RFQ) stage; a drift tube linac (DTL) stage; and a side-cavity coupled linac (SCL) stage. The transition from the DTL stage to the SCL stage is typically positioned at a point in the accelerator at which the velocity of the accelerated particles reaches a velocity of 0.4 to 0.5 times the speed of light, at which the shunt impedance of the DTL and SCL linac stages are almost equivalent.

The DTL technology was developed in the late 1940's and is still the most widely used technology at lower beam velocities. Although DTL-based proton acceleration linacs have been used for many years, they are relatively bulky and difficult to service. They require a different RF power source than the higher energy segments of the accelerator, and are expensive to fabricate because of the need to incorporate quadrupole magnet focusing cells within the drift tubes.

Accordingly, it is the object and purpose of the present invention to provide a linear particle accelerator having accelerator cavities that are simpler and less expensive to construct and service and, in particular, which are free of side cavities or other off-axis coupling cavities.

In particular, it is an object and purpose of the present invention to provide a simpler linear particle accelerator structure that achieves the foregoing objective and which is suitable for use in the high-energy range that has previously been addressed with side-cavity coupled structures, up to and including energy levels approaching the velocity of light, or one MeV and above in the case of electrons.

It is also an object to provide a simpler linear particle accelerator that may also be useful as well in the lower-energy range previously addressed with DTL technologies.

SUMMARY OF THE INVENTION

The present invention provides a linear particle accelerator for accelerating charged particles such as protons, electrons or ions, by their interaction with a standing electromagnetic wave maintained within the accelerator. Particles are introduced at one end of the accelerator body, referred to as the injection end, and are emitted at the opposite end, referred to as the emission end.

In one preferred embodiment the accelerator includes an elongate hollow accelerator body having an outer wall that is generally coaxial with the longitudinal axis of the accelerator. The accelerator body further includes a series of transverse interior walls spaced longitudinally along the beam line. Transverse end walls cap the accelerator body at each end. The body and the walls are formed of copper or other suitable conductor. A central longitudinal bore through the end walls and the interior walls forms a beam line along which the charged particles are accelerated.

The outer wall and the transverse walls form a series of accelerator cells, each of which defines a resonant cavity in which a standing electromagnetic wave may be maintained. The cells along the length of the accelerator are sized and shaped such that their cavities have substantially the same resonant frequency, while preferably also providing an increasing phase velocity in the standing waves toward the emission end of the accelerator, so that the standing waves in the cavities are synchronized with the charged particles as they are driven to increasingly greater velocities along the length of the accelerator.

Adjacent cells of the accelerator share a common interior wall. A slot passes through each interior wall and connects the two resonant cavities on either side. Each slot is offset from the longitudinal axis of the accelerator and is oriented so that its major axis extends transverse to the radial direction with respect to the longitudinal axis of the accelerator. In one preferred embodiment each slot is semicircular in shape, with its arc of curvature being centered on the longitudinal axis of the accelerator, and with the slot extending through an azimuthal angle of approximately 120 to 180 degrees. In this embodiment the length of each slot is such that the slot itself has a resonant frequency approximately equal to the resonant frequency of the cavities. Thus any two adjacent cavities are coupled to the slot between them, and thus are coupled to each other through the slot The slots, by resonating at a frequency comparable to that of the cavities, function in a capacity similar to that of the side cavities in a traditional side coupled accelerator. This preferred embodiment is referred to as "biperiodic," meaning that a complete period consists of two resonators of comparable resonant frequency, or one cavity and an adjacent slot.

The slots in adjacent interior walls are preferably positioned on opposite sides of the beam line from one another, such that the slots alternate in position along the length of the accelerator from one side of the beam line to the other, in order to minimize direct coupling between the slots in adjacent walls.

The accelerator body includes an input port in its outer wall, preferably near its center, for introduction of a high power radiofrequency input signal that produces and maintains the standing wave along the length of the accelerator body. Since the accelerator is based on use of a standing wave, no outlet port is necessary or desired. Typically the accelerator is powered by a klystron, which introduces a microwave signal having a power level of from hundreds of kilowatts to tens of megawatts, through a waveguide connected to the input port of the accelerator body.

By suitable selection of the frequency of the input signal and tuning of the reflective end cells, the standing wave in the cells is maintained in the $\pi/2$ mode, such that the resonant standing wave in each cell is maintained in phase with the standing wave in the next cell, and with their antinodes, or points of maximum electric field magnitude, located in the cells and their nodes located in the slots. By so maintaining the standing wave in the $\pi/2$ mode, a charged particle is accelerated by the standing wave as it passes through each cavity. Thus each cavity functions as a "live" accelerating cavity.

As noted, the charged particles increase in velocity as they are accelerated, and synchronism between the particles and the standing wave in each cavity must be maintained, for example by progressively increasing the length of the cells along the length of the accelerator, while also shaping the cells to maintain a constant resonant frequency. Thus the phase velocity of the standing wave increases toward the emission end of the accelerator tube while the standing wave also remains in synchronism with the charged particles as they increase in velocity.

Each interior wall includes a pair of tubular nose cones that extend from opposite sides of the wall into the two cavities on opposite sides of the wall. Each end wall similarly includes a single nose cone extending into the cavity adjacent the end wall. Each nose cone has a central bore aligned with the bores passing through the transverse walls, such that they define a beam tube that is interrupted by openings into the central regions of the cavities. In the biperiodic embodiment the tips of opposing nose cones extending into a cavity are spaced from one another to form a gap, which is preferably centered longitudinally in the cavity, in order to concentrate and optimize the timing and effectiveness of the alternating electric field in accelerating a particle as it passes across the gap between the nose cones and through the center of the cavity.

In a second preferred embodiment the accelerator is either triperiodic or of a higher order of periodicity. In this embodiment some of the interior walls have resonant slots, which resonate at a frequency comparable to that of the cavities as described above, and other interior walls have one or more shorter slots, which have a resonant frequency distinctly higher than that of the cavities and the resonant slots. The shorter slots are referred to herein as nonresonant slots to distinguish them from the longer, resonant slots. The lengths of the nonresonant slots are preferably selected so that they have resonant frequencies on the order of twice the resonant frequencies of the cavities and the resonant slots. As with the embodiment described above, the lengths of the resonant slots are selected so that the passbands of the resonant slots and the passbands of the cavities overlap.

In this second preferred embodiment, the interior walls having resonant slots are separated by as many as four walls having nonresonant slots. Further, the midpoints of the gaps between opposing nose cones in adjacent cavities connected by a resonant slot are spaced by a distance of $\beta\lambda$, while the midpoints of the gaps between opposing nose cones in cavities connected by a nonresonant slot are spaced by a distance of $\beta\lambda/2$. A suitable input signal is selected so as to maintain a standing wave in the accelerator in the $(n+1)\pi/(n+2)$ mode, where n is the ratio of the number of interior walls having nonresonant slots, to the number of interior walls having resonant slots.

Such an embodiment having two cavities for every resonant slot is referred to as "triperiodic," which means that a complete period consists of two cavities and an associated resonant slot, with the nonresonant slots being disregarded for this purpose.

As with the first preferred embodiment, the end cells of the accelerator are tuned to cause the nodes of the standing waves in the cavities to occur in the slots. Also as with the first embodiment, the phase velocity of the standing wave increases progressively toward the emission end of the accelerator so as to be maintained in synchronism with the charged particles as they are accelerated along the length of the accelerator. This may be achieved by increasing the lengths of the cells along the length of the accelerator tube toward the emission end. The accelerator tube may be tapered in diameter to maintain a substantially constant resonant frequency.

These and other aspects of the invention are more fully described in the detailed description set forth below, taken with the accompanying drawings.

BRIEF DESCRIPTION OF THE DRAWINGS

The accompanying Figures, when taken with the detailed description of the invention set forth below, illustrate the construction and operation of the present invention.

In the Figures.

DETAILED DESCRIPTION OF THE INVENTION

The present invention provides a linear standing wave particle accelerator having a series of resonant accelerating cells connected by slots, at least some of which slots are sized and shaped so as to be resonant at a frequency comparable to that of the accelerating cells.

Figure 1:
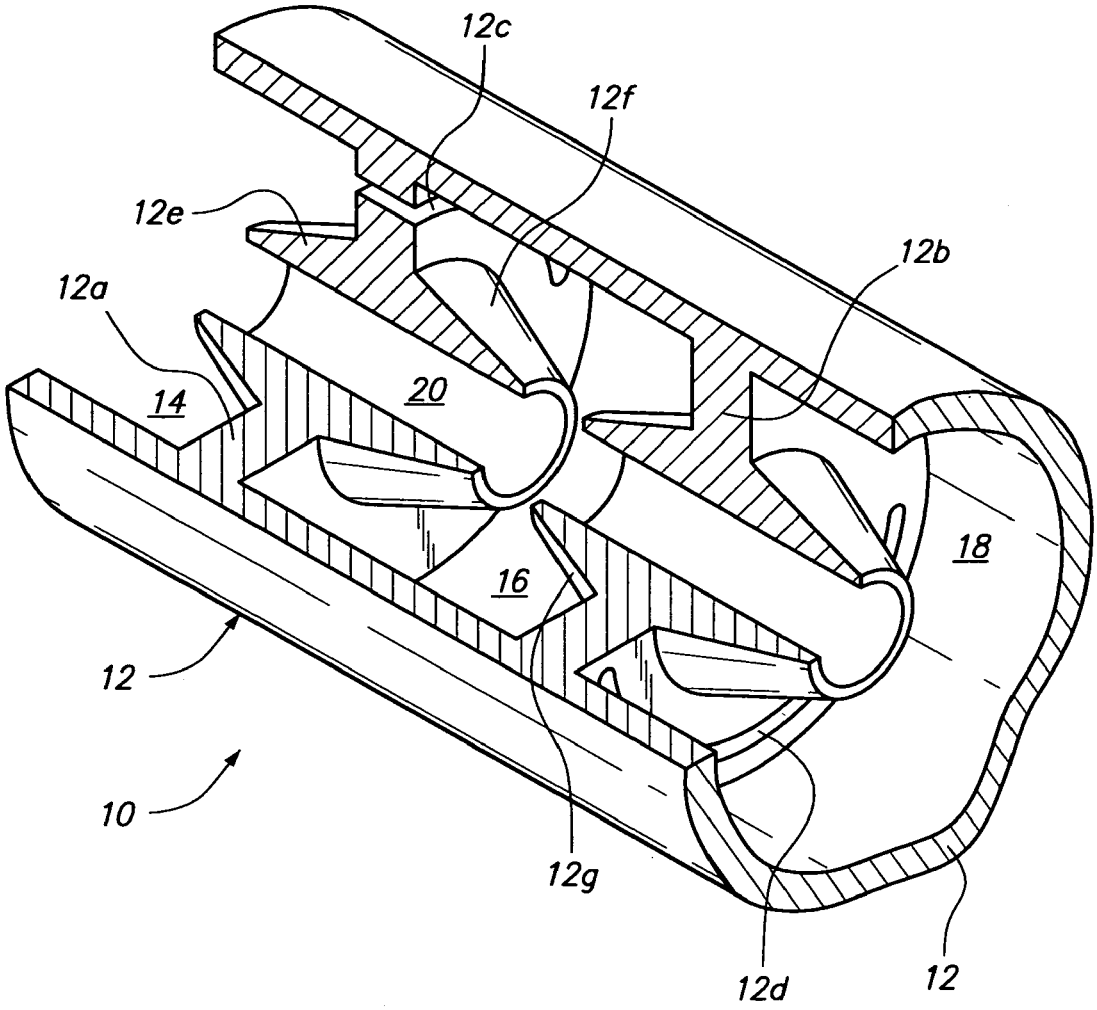
FIG. 1 is an isometric view in partial cross section of one segment of a preferred embodiment of a biperiodic linear particle accelerator constructed in accordance with the present invention, with it being understood that a number of segments similar to that shown in FIG. 1 are positioned in sequence along the beam line of the accelerator.
Figure 3:
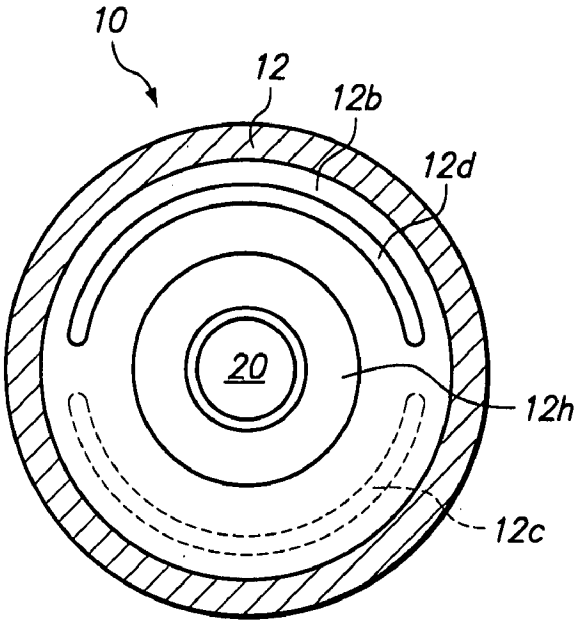
FIG. 3 is an end view in cross section of the segment shown in FIGS. 1 and 2, taken along section line 3-3 of FIG. 2.
Figure 2:
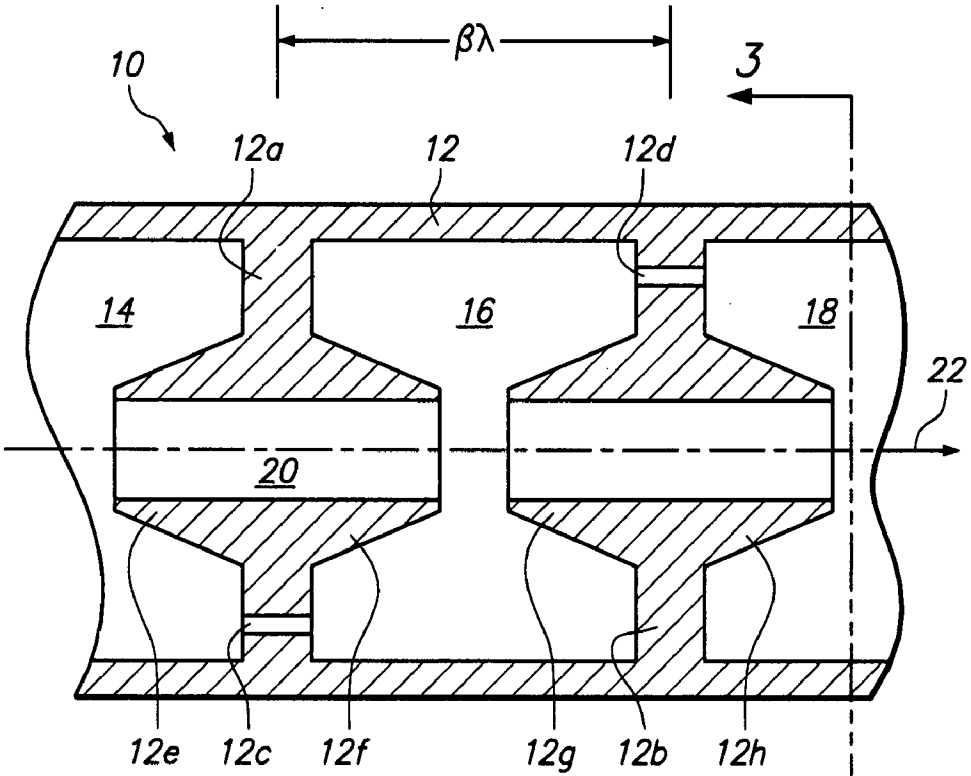
FIG. 2 is a side view in cross section of the segment of the accelerator shown in FIG. 1.

FIGS. 1 through 3 illustrate a segment 10 of a linear standing wave accelerator constructed in accordance with a first preferred embodiment of the present invention, which is referred to herein as "biperiodic" for reasons explained below. The segment 10 includes a cylindrical copper accelerator tube 12 having transverse interior walls 12*a* and 12*b*, which together partially define three successive accelerating cells, or cavities, 14, 16 and 18 (additional interior walls adjacent cavities 14 and 18 are not shown). Cells 14 and 16 share a common interior wall 12*a*, and cells 16 and 18 share common interior wall 12*b*.

While the terms "cell" and "cavity" are generally used interchangeably herein, the term "cell" refers more specifically to the structures defined by the outer tube 12 and the various transverse walls such as walls 12*a* and 12*b*, while the term "cavity" refers to the volumetric spaces contained within those structures.

Figure 4:
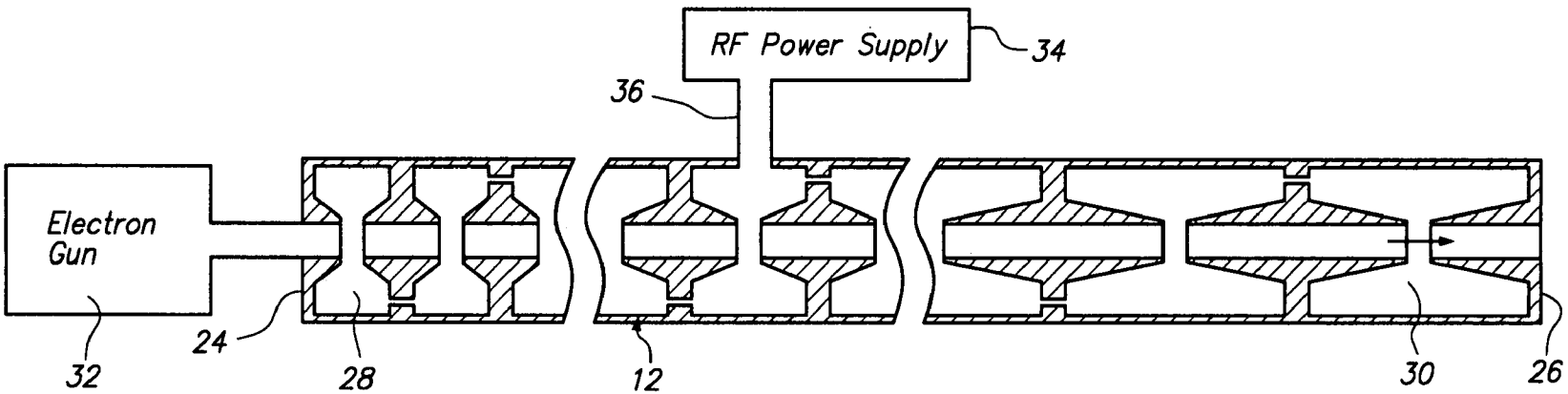
FIG. 4 is a schematic partial illustration of a complete accelerator containing segments such as those shown in FIGS. 1 through 3, such as may be used for acceleration of electrons.

Each pair of cells along the accelerator tube 12 shares a common transverse interior wall, as shown in FIGS. 1, 2 and 4, discussed further below. It will be understood various cells along the accelerator tube 12 are functionally equivalent, and are structurally equivalent except with regard to dimensional variations that are necessary to maintain a constant resonant frequency for each cell along the length of the accelerator tube 12, as also discussed further below. The number of cells in the accelerator will depend on the purpose of the accelerator and the type of particles accelerated (e.g., protons, electrons, or ionic particles), but may be as many as several hundred cells.

Referring in particular to FIGS. 2 and 3, the three cavities 14, 16 and 18 are generally cylindrical in shape, with a central bore 20 passing through the interior walls 12*a* and 12*b*. Central bore 20 defines the nominal location of a beam line 22 that extends along the longitudinal axis of the accelerator.

The internal transverse walls 12*a* and 12*b* include semicircular, azimuthally extending resonant coupling slots 12*c* and 12*d*, respectively, passing therethrough. Slot 12*c* connects cavity 14 and cavity 16, and slot 12*d* connects cavity 16 and cavity 18. Each slot 12*c* and 12*d* extends through its associated interior wall over an azimuthal angle of between 120° and 180°, as viewed along the longitudinal axis of the beam line 22 (FIG. 3).

The injection and emission ends of the accelerator tube 12 are capped with transverse end walls 24 and 26 (FIG. 4), which are adjacent reflective end cells 28 and 30, respectively. The beam tube bore 20 passes through end walls 24 and 26, but the end walls 24 and 26 do not include coupling slots such as are formed in the interior walls. The function of the reflective end cells 28 and 30 is to reflect a microwave signal in the accelerator tube 12 and to thereby enable a standing wave to be maintained in the tube 12, with the standing wave resulting from the constructive interference of waves traveling in opposite directions from one another. The end cells 28 and 30 are either half-cells or are sized and otherwise tuned, by methods known in the art, to control the phase of the reflected wave so that the nodes of the standing wave occurs at the coupling slots in the interior walls.

Referring to FIGS. 1-3, the slots 12*c* and 12*d* in walls 12*a* and 12*b* are essentially identical in size and shape, but are positioned on opposite sides of the beam line 22. That is, they are rotated by 180 degrees relative to one another in the azimuthal direction, as viewed longitudinally and as shown in FIG. 3, in order to compensate for dipole kicks produced by the slots. Also, the 180 degree azimuthal offset of the slots minimizes any direct coupling between slots in adjacent interior walls. All of the slots connecting the various cells of the accelerator structure are similarly positioned, so as to result in an alternating azimuthal positioning of successive slots along the length of the accelerator.

FIG. 4 illustrates in schematic form the accelerator as it may be used for acceleration of electrons, for example in medical applications. The accelerator includes the accelerator tube 12, an electron gun 32, and a radio frequency power supply 34 which is connected to the accelerator tube 12 by a waveguide 36. The electron gun 32 consists of any suitable source of electrons available in the prior art, and preferably provides a stream of electrons accelerated to an initial energy level of 10 to 50 KeV. The power supply 34 is a microwave power supply such as a klystron or magnetron capable of producing an input signal having a power level of at least hundreds of kilowatts. The accelerator tube 12 may include typically from 10 to 100 cells along its length, which are connected by coupling slots as described above.

The power supply 34 is preferably connected by waveguide 36 to the accelerator tube 12 near the center of the tube 12 in order to optimize the distribution of power in both directions along the length of the accelerator tube 12. In operation, the power supply 34 provides the power necessary to both maintain a standing wave along the entire length of the accelerator tube 12 and to also accelerate electrons as they pass through each cell in accelerator tube 12.

FIG. 4 also shows the reflective end cells 28 and 30 at opposite ends of the accelerator tube 12 as being of different lengths, in exaggerated proportion, to illustrate that the dimensions of the cells may vary from one end of the accelerator to the other. Such a variation is one way to synchronize the phase of the resonant standing wave in the cells with the positions of the electrons passing through the cells as they progressively increase in velocity along the length of the accelerator. Thus the end cell 30 at the emission end of the accelerator is elongated relative to the end cell 28 at the injection end, so that the phase velocity of the standing wave increases toward the emission end and the electrons passing through the cells thus remain synchronized with the standing wave as they increase in velocity. A constant resonant frequency may be maintained in cells of increasing length by, for example, using cells of progressively smaller diameter toward the emission end, as shown in the embodiment illustrated in FIG. 8 (discussed below), which is not to scale.

Figure 5A:
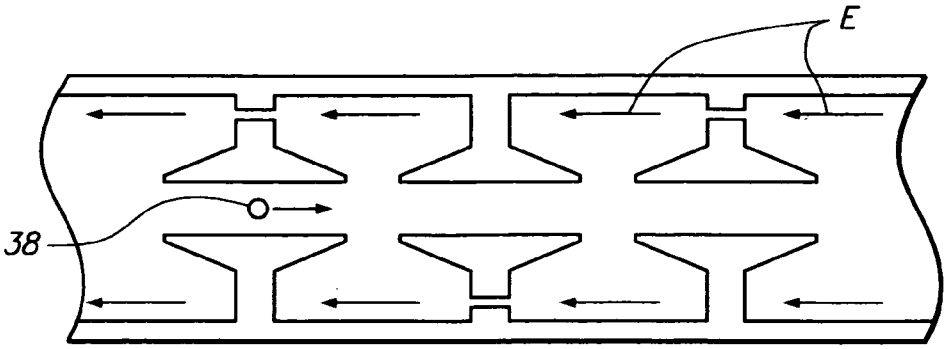
FIGS. 5A-5D show a schematic illustration of the peak electric fields in a sequence of accelerator cells at consecutive points in time, and showing the synchronism between the peak electric fields and the position of a charged particle as it travels through the cells.
Figure 5B:
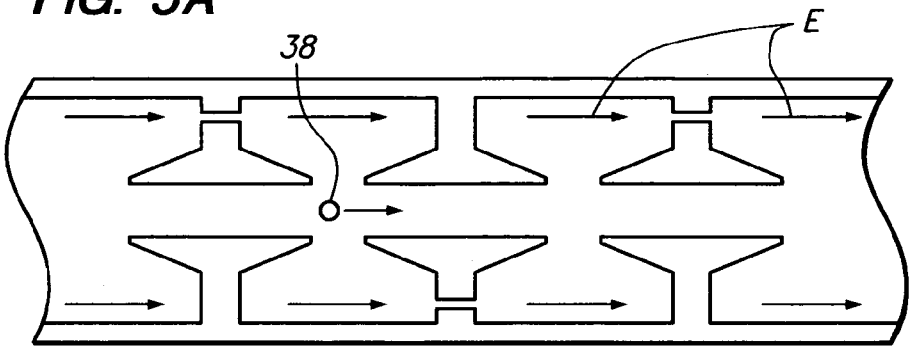
Figure 5C:
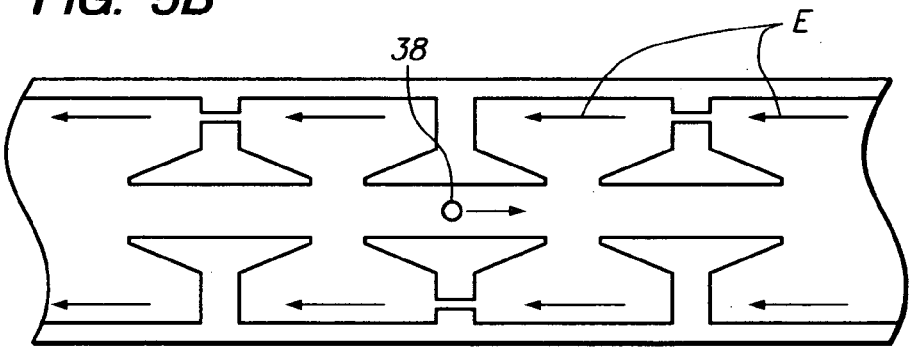
Figure 5D:
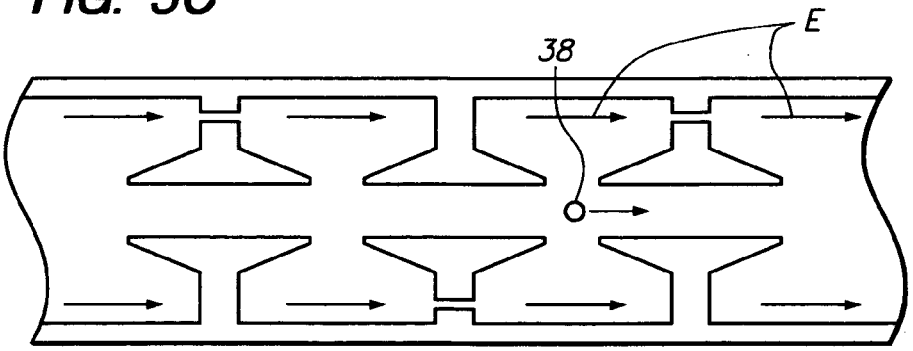

FIGS. 5A through 5D illustrate the electric field component E of the standing wave in a series of accelerator cells, as it varies over time as a particle 38 passes through the cells. The electric field component E extends longitudinally in both directions along the axis of the accelerator and varies sinusoidally. The frequency of the input signal is selected so that the standing wave resonates in what is referred to herein as the $\pi/2$ mode. The resonating electric field components E in the various cells are in phase with one another, and that the nodes of the alternating electric fields are at the slots and the antinodes are centered longitudinally in the cells. The frequency of the standing wave is synchronized with the velocity of the particle 38 at the various points along the accelerator, such that the electric field E in each cell goes through one full cycle in the time that a particle 38 travels from one cell to the next, for example from the position shown in FIG. 5B to the position shown in FIG. 5D. The electric field E is at its maximum strength in the forward direction as the particle 38 passes through the center of a cell (FIGS. 5B and 5D), thereby accelerating the particle 38. While the particle 38 travels through the nose cones between cells (described below), the field E extends in the reverse direction but has no effect on the particle 38 because the nose cones act as insulating Faraday cages (FIGS. 5A and 5C). By the time the particle 38 arrives at the next cell and is positioned in the gap between its nose cones, the electric field E is again in the forward direction and thus further accelerates the particle 38.

Figure 6A:
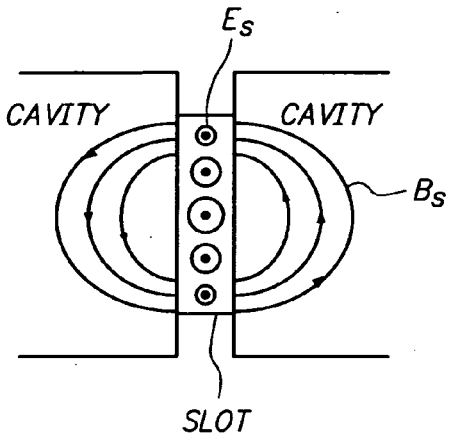
FIGS. 6A-6B show two schematic side views of an accelerator segment having two cavities connected by a slot, and showing the directions of the electric and magnetic fields associated with a signal resonating in the slot, taken at two points in time 180 degrees apart in phase.
Figure 6B:
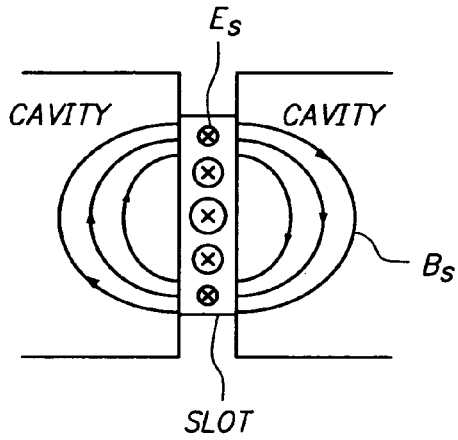

FIGS. 6A and 6B illustrate schematically a side view of the electric field $E_s$ and the corresponding magnetic field $B_s$, of a signal resonating within a resonant slot, taken 180 degrees apart in phase. Both fields are illustrated as they would exist in the absence of any resonating signal in the adjacent cavities. The electric field $E_s$ varies sinusoidally and extends transversely to the longitudinal axis of the slot, i.e., into and out of the plane of the paper as illustrated; or, in the case of the accelerator, in the radial direction with respect to the axis of the accelerator. The resonating magnetic field, $B_s$ also varies sinusoidally, wrapping around the axis of the electric field $E_s$ and extending for some distance into the adjacent cavities on opposite sides of the slot, where it extends in opposite directions with respect to the major axis of the slot. Further, because the slot is offset from the axis of the accelerator, i.e., to one side of the beam line, the magnetic field $B_s$ will interact with an azimuthal magnetic field component of a resonant standing wave in either of the adjacent cavities.

Figure 7A:
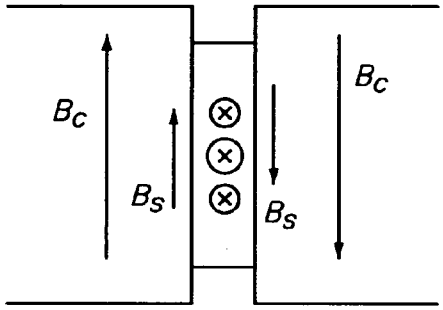
FIGS. 7A-7C show a schematic side view of the cavities and slot as shown in FIGS. 6A-6B, and the relative directions of the magnetic and electric fields associated with resonant signals in the cavities and the slot, in the $\pi$, $\pi/2$, and 0 modes.
Figure 7B:
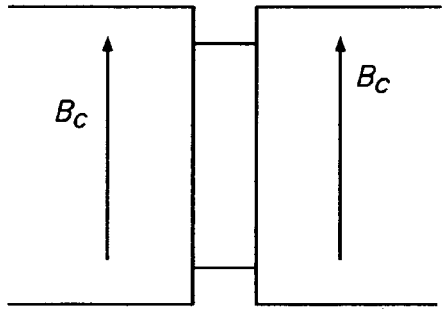
Figure 7C:
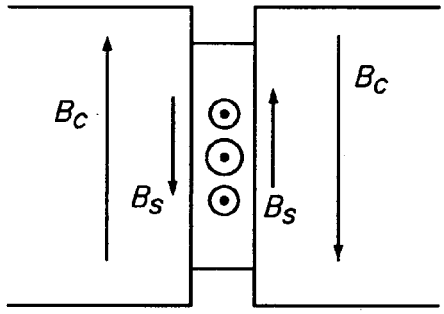

FIG. 7 illustrates such interactions schematically with regard to three different modes. In FIG. 7, $B_c$ represents the magnetic field components of the signals in the two resonant cavities on opposite sides of a resonant slot. FIG. 7A illustrates the 0 mode for a pair of cavities connected by a resonant slot, FIG. 7B illustrates the $\pi/2$ mode for the same cavities and slot, and FIG. 7C illustrates the $\pi$ mode. In this regard, the terms "0 mode," "$\pi/2$ mode" and "$\pi$ mode" refer to the mode in which a complete period extends from one resonant circuit to the next, i.e., from one resonant cavity to the next resonant slot.

In both the 0 mode and the $\pi$ mode, the azimuthally resonating magnetic field components $B_c$ of the standing wave in two adjacent cavities are 180 degrees out of phase with one another and thus extend in opposite directions at any point in time. Thus they may each extend either in the same direction as the magnetic field component $B_s$ that extends into the same cavity in the 0 mode (FIG. 7A); or they may each extend in the direction opposite to that of the component of the magnetic field $B_s$ extending into the same cavity in the π mode (FIG. 7C). Thus, as long as the resonance frequency of the slot is comparable to the resonance frequency of the adjacent cavities, a resonant signal in the slot can coexist and couple with the resonant signals in the adjacent cavities in either the 0 mode or π mode.

However, for the π/2 mode shown in FIG. 7B, the resonating azimuthal magnetic fields $B_c$ in the cavities extend at all times in the same direction as one another and are in phase with one another, so no significant resonant signal can coexist in the resonant slot, because the magnetic field $B_s$ of the slot would necessarily be in conflict with one or the other of the magnetic fields $B_c$ in the immediately adjacent cavities.

Now turning to the function of the coupling slots in more detail, each slot, taken alone, acts as a transmission line shorted at both ends and thus has a resonance frequency associated with it. So long as the length of the slot is equal to λ/2, where λ is the wavelength of the resonant signal in the adjacent cavities, the slot itself is capable of functioning as a resonator at the same frequency as that of the cavities. Referring to FIGS. 1-3 and 5, since the major axis of each slot extends in the azimuthal direction, the alternating electric field $E_s$ in the slot can extend effectively only in the radial direction, in order to satisfy the basic requirement of electromagnetic resonance that an electric field must extend perpendicular to a reflecting conductive surface. Thus, as described above, the alternating magnetic field $B_s$, associated with a resonating signal in the slot, wraps around the alternating electric field $E_s$ in the slot and extends azimuthally alongside the slot in opposite directions on opposite sides of the slot; while passing around the radial axis of the electric field $E_s$ and through the slot at each end. Since the alternating magnetic field $B_s$ extends partially outside the slot and into the adjacent cavities, it is capable of coupling with the alternating azimuthal magnetic fields $B_c$ in the adjacent cavities. Thus the resonant slots are capable of magnetically coupling adjacent cavities.

Thus, for the standing wave components in adjacent cavities to resonate in phase with one another, so that every cavity can function as a "live," or accelerating cavity with every cycle of the standing wave, the slots themselves cannot resonate with any significant signal strength. Thus, so long as the standing waves in adjacent cavities are balanced in strength and are in phase with one another, the resonant signal in the slot between them is negligible and the slot acts as a "dead" resonator, as shown in FIG. 7B, much the same as a side cavity in a traditional side-cavity coupled accelerator. Thus in the π/2 mode the slot effectively functions as a resonator only to couple adjacent cavities and to correct imbalances between the resonant signals in the adjacent cavities.

As a practical matter, there is in fact a small net traveling wave component in the slots (not shown in the Figures), which transmits a portion of the input signal power through the slots. Some transmission of power through the slots is necessary to transmit sufficient power in both directions along the accelerator tube, to compensate for power that is dissipated at various points along the accelerator during operation through ordinary losses as well as by acceleration of particles.

The operation of the slot resonance coupled accelerator as thus far described can also be explained by comparison with the operation of a conventional side-cavity coupled linac (SCL). In the SCL there is an off-axis side cavity that couples each pair of neighboring on-axis cavities. Each off-axis cavity, or coupling cavity, has two ports that open into two neighboring on-axis cavities. The two coupling ports are located on one side of the coupling cavity, such that a resonant magnetic field in the coupling cavity couples to the on-axis cavities by means of two field components that necessarily extend in the same direction. In contrast, in the present invention the magnetic field components associated with the resonant slot extend from opposite sides of the resonant slot, and thus present to the two neighboring cavities as magnetic fields extending in opposite directions. Thus, in the present invention the electric fields in neighboring cavities are reversed in direction relative to the situation in the SCL. This field reversal also dictates the choice of gap-to-gap separation in order for a particle to be synchronous with the standing wave. Whereas in the SCL the gap-to-gap distance is βλ/2, in the present invention the gap-to-gap distance is βλ.

Normally an accelerator tube constructed in accordance with the present invention as thus far described has two passbands, one associated with the resonant slots and one associated with the resonant cavities, and with a stopband between them. Each passband represents a range of frequencies which is readily transmitted through the cavities or the slots. Achieving balanced and synchronized standing waves in the cavities is accomplished by tuning the cavities and the slots so as to "close the gap" between the passbands, or to superimpose the passband of the slots on the passbands of the cavities, such that there is effectively only a single passband associated with the standing wave, which passband is continuous in the vicinity of the π/2 mode. This results in a standing wave with the nodes in the slots having the same frequency as a standing wave would have with the nodes in the cavities. Further, in the standing wave accelerator of the present invention it is desirable to have a wide passband, in order to maximize the frequency separation between the π/2 operating mode and adjacent modes. Maximum separation between these modes is desirable because it reduces leakage of power into the adjacent modes, which do not significantly contribute to acceleration of the particles and which distort the field profile, and thereby optimizes the power efficiency of the accelerator.

The accelerator structure is designed to obtain a closed dispersion curve, which is a curve that describes the phase advance per cell as a function of the operating frequency. This is accomplished in the first instance by using finite element analytical methods, using boundary conditions selected to model a structure of semi-infinite length. To obtain a closed dispersion curve, the operating frequencies of two π/2 modes are compared; the first with the cells active and the slots inactive, and the second with the cells inactive and the slots active. When both of these modes are tuned to the same desired operating frequency and are thus equal to each other, the dispersion curve becomes closed and the stopband no longer exists.

Further in this regard, it is notable that tuning to close the gap between passbands is made easier by the fact that tuning the slot frequency by varying the slot length has a strong effect on the π/2 mode when the slot is live, and very little effect on the π/2 mode when the cavity is live. Conversely, tuning the cavity frequency by changing the diameter of the cells or changing the gap length has a strong effect on the π/2 mode with the cavity live, and little effect on the π/2 mode when the slot is live. This is because changing any dimension in a resonant structure changes the resonant frequency by an amount proportional to the square of the field at the surface being moved. Thus changing the length of the slot has almost no effect on the frequency of the mode in which the slot is the node, and similarly changing the diameter of the cavity has almost no effect on the frequency of the mode in which the cavity is the node. The sign of the frequency change for the electric fields is the opposite of the sign of the frequency change for the magnetic fields, so it is preferable to tune the surface where one or the other dominates.

As a result the microwave field strengths in the slots are maintained at levels significantly less than the field strengths in the cavities, and the resonating signals in the slots thus do not conflict with the signals in the cavities.

Further, the reflective end cells are preferably tuned so as to maintain "field flatness," i.e., to achieve equivalent on-axis peak electric field strengths in all cells, or to otherwise tailor the relative field strength along the length of the accelerator as may be desired to achieve appropriate distribution of peak field strength along the length of the accelerator.

Thus the slots function as resonators between the accelerating cells, and in this regard the properly tuned slots are coupled to the adjacent cavities and serve the same function as the side cavities of a comparable side-cavity coupled linear accelerator. The present invention makes side cavities unnecessary, yet with each cavity in the accelerator tube functioning as a "live" or accelerating cavity.

Returning to FIGS. 1 through 3, the interior walls 12*a* and 12*b* each include two integral, conical hollow nose cones, 12*e* and 12*f*, and 12*g* and 12*h*, respectively, which extend longitudinally in opposite directions along the axis of the bore 20. The nose cones function to synchronize the timing of the peak electric fields in each cell with the position of the charged particles between the ends of opposing nose cones as they pass through the cells, for example the region between the opposing ends of nose cones 12*f* and 12*g* in cavity 16, and as shown in FIG. 5. The nose cones also concentrate the electric field in the gaps between the nose cones. This is desirable because the amplitude and direction of the electric field in each cavity varies sinusoidally and thus acceleration is optimized if the forward direction and the maximum field strength of the electric field are timed to occur as particles are passing through the center region of each cavity.

The preferred embodiment shown in FIGS. 1-3 is designed to operate at a resonant frequency of approximately 805 Mhz. For such an operating frequency the cavities have a nominal diameter of approximately 6.8 inches. For such cavities operating at a value of $\beta$ of approximately 0.4, the cavity length is approximately 5.9 inches. The thickness of the interior walls is approximately 1.0 inch and the bore 20 is approximately 1.5 inches in diameter. The nose cones are approximately 1.9 inches in length and have large end diameters of 4.0 inches and a small end diameters of 2.0 inches. For such a structure the optimum slot extends over an azimuthal range of approximately 148 degrees and has inner and outer radii of approximately 5.5 and 6.0 inches, respectively.

The structural elements shown in FIGS. 1-3 are illustrated as having distinct edges and corners for purposes of illustration. However it will be understood that in practice the internal edges and corners may be rounded. Sharp edges in the vicinity of a large electric field result in edge effects that concentrate the field and may cause electrical breakdown. Rounding the edges raises the power level at which such breakdown occurs and thereby allows the use of higher field strengths and acceleration gradients. Similarly, rounding the internal edges and corners in a region of high magnetic field minimizes the surface area exposed to such field and thereby decreases RF losses. Rounding and related modifications may be accompanied by adjustments in the geometry of the cavity so as to maintain the desired resonant frequency.

As noted above, in the illustrated preferred embodiment the cavities increase in length in the longitudinal direction along the length of the accelerator, with each cavity having a length equal to $\beta\lambda$ (see FIGS. 2 and 4), where $\lambda$ is the free space wavelength of the standing microwave signal used to accelerate the particles, and $\beta$ is the ratio of the velocity of a particle passing through the cell to the velocity of light, as defined above. For low values of $\beta$ of approximately 0.2 to 0.5, this is an advantage, as it allows the cavities to have a greater length, and therefore to have a higher shunt impedance per cavity.

The embodiment of the accelerator thus far described is referred biperiodic because a complete period consists of two resonators having comparable resonant frequencies, i.e., one cavity and one slot, but has neither side cavities nor any on-axis coupling cavities. Thus the structure is almost axisymmetric, yet smaller than a comparable side-cavity coupled accelerator because it has no side cavities.

As noted, the accelerator operates with a $\pi/2$ phase shift from a cavity to the next adjacent slot, yet the cavities all have the same phase and thus appear to be in the 0 mode. This is in fact analogous to certain drift tube accelerators, which are stabilized by having $\lambda/4$ resonant stubs which couple from period to period. Such drift tube accelerators also operate in the $\pi/2$ (90 degree) mode, but because the magnetic field wraps around the resonant stubs there is a field reversal and the accelerator thus operates in the zero mode.

As noted above, in the present invention the coupling slots are sized and shaped so that the frequency of the $\pi/2$ mode when the nodes are in the resonant slots is approximately the same as the frequency of the $\pi/2$ mode would be if the nodes were in the accelerating cavities. The fields thus have the same phase in every cavity, so the length of any particular cavity must be $\beta\lambda$, where $\beta=v/c$ is the particle velocity normalized to the velocity of light, and $\lambda$ is the free space wavelength of the standing wave signal used to accelerate the particles.

A common measure of the efficiency of an accelerator structure is the shunt impedance per unit length, R, usually quoted in megohms per meter. Shunt impedance is the ratio of the square of the energy gained per meter, in MeV, to the power in megawatts dissipated per meter in the structure. For cavities with nose cones, the shunt impedance is known to increase with the cavity length up to a cavity length of $\lambda/2$. Consequently, the accelerator of the present invention is more efficient than side-cavity coupled accelerators for values of $\beta$ less than 0.5, and may be more efficient for values of $\beta$ up to approximately 0.75. This advantage may extend up to values of $\beta$ as high as 0.75 because the optimum cavity has nose cones that are $\lambda/4$ long, so the periodic length is $\lambda/2$, in addition to the gap length (perhaps $\beta\lambda/4$ or $\beta\lambda/5$) and the wall thickness (perhaps $\lambda/20$). Yet the accelerator of the present invention is considerably simpler and cheaper to fabricate.

As noted, the resonant slot coupling of the present invention results in an additional 180 degree phase shift between the accelerator cavities. This results in the magnetic fields in any two adjacent accelerator cavities extending in opposite directions in both the 0-mode and the $\pi$-mode, as shown in FIG. 7, which is opposite from the situation in a comparable side-cavity coupled accelerator. This sign reversal causes the two magnetic fields in the accelerator cavities to point in the same direction at the $\pi/2$ phase advance point in the dispersion curve. This is a critical difference between the function of the slot-coupled accelerator of the present invention and a side-cavity coupled accelerator. In addition, the fact that the accelerating cavities all have the same phase has another benefit, which is that the currents flowing on either side of a wall between cavities flow in opposite directions, so the net current is zero. This means that the relatively long slots required for resonance at the operating frequency actually result in less loss than the much shorter slots in a side-cavity coupled accelerator. The resonant slots of the present invention have the effect of increasing the coupling by a factor of about 4 compared with typical side-cavity coupled accelerators, which relaxes fabrication tolerances by the same factor. Further, the frequency of the slot resonance is primarily dependent only on its length and is relatively independent of the slot width or the thickness of the wall. Thus the use of slot resonance does not add wasted space to the structure. While the walls between adjacent cavities need to be thicker for mechanical reasons to accommodate the slots, simply because the slots weaken the walls structurally, there are only half as many walls, so they can be twice as thick and yet consume the same fraction of the accelerator length. Also, the fact that there are half as many walls between cavities (because the cavities are $\beta\lambda$ long rather that $\beta\lambda/2$ long) means that there is half as much resistive loss in the walls between cavities. This, together with the fact that coupling losses are lower than for a side coupled accelerator, may allow the shunt impedance of an accelerator constructed in accordance with the present invention to be competitive for values of $\beta$ up to approximately 1.0.

As also previously noted, in order for the structure to be synchronous with the particle beam, the longitudinal distance between accelerator gaps is approximately $\beta\lambda$, as shown in FIG. 2. This is twice the distance as that of a comparable side-coupled linac. For $\beta\approx1$, this is a potential disadvantage, as the available spacing for each cell might be increased beyond the optimum. For low-beta (0.2 to 0.5), however, this is an advantage, as it allows the cells to occupy a greater longitudinal extent, and therefore have a better shunt impedance per cell.

If the shunt impedance of the structure for $\beta=1$ is within 10 to 15% of the shunt impedance of a comparable side-cavity coupled accelerator, a slot resonance coupled accelerator constructed in accordance with the present invention may be up to 10 to 15% longer while requiring the same amount of power, although it is nevertheless simpler and thus less expensive to fabricate than a comparable accelerator having side-coupled cavities or other on-axis coupling structures. By eliminating side cavities, and because the cavities of the present invention have a length of $\beta\lambda$, instead of $\beta\lambda/2$, the number of machined parts is substantially reduced, nominally by a factor of 4. However, for the same average gradient and gap length, the peak fields will be twice as high as for a side-coupled linac.

Figure 8:
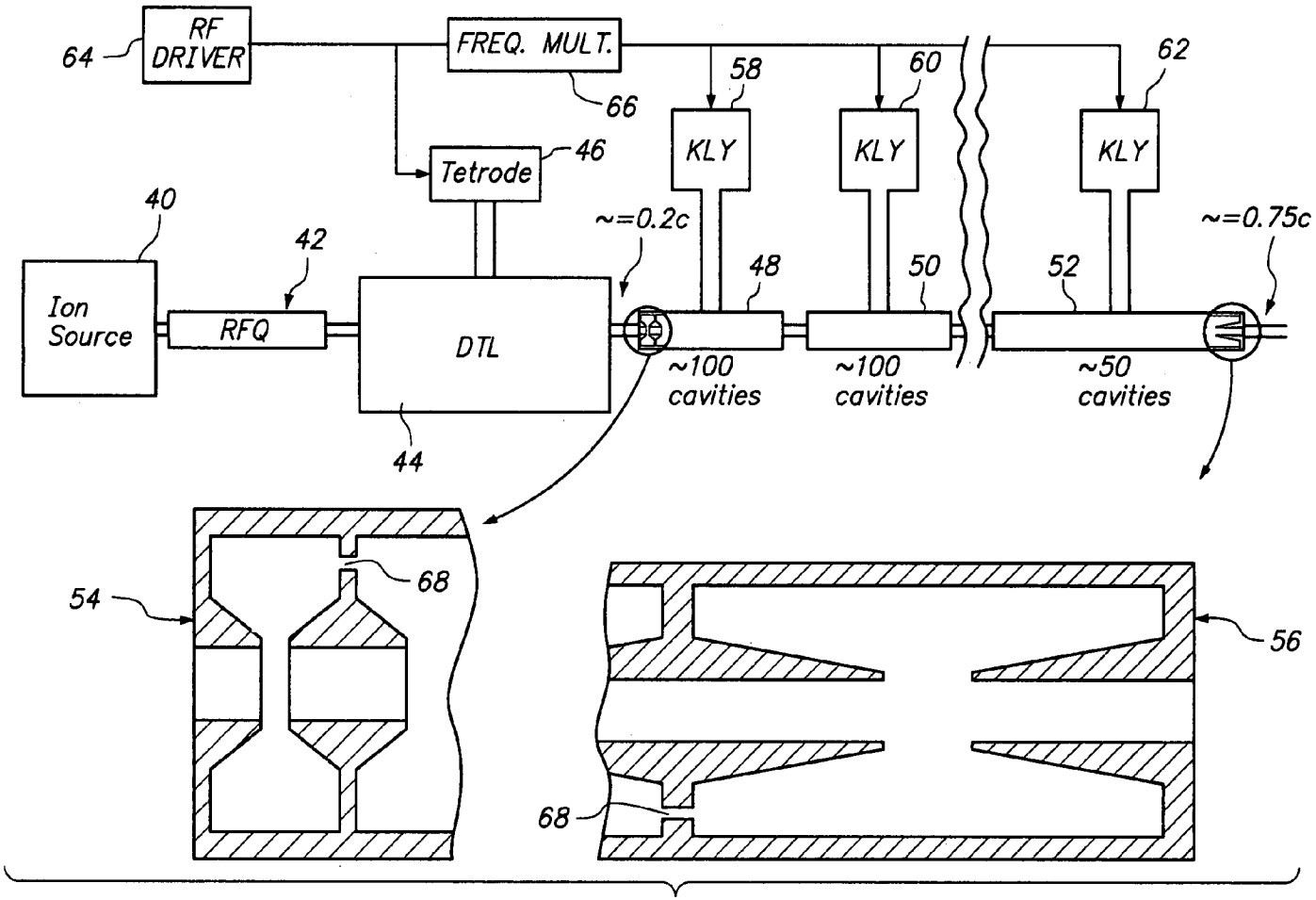
FIG. 8 is a schematic partial illustration of a biperiodic accelerator intended for acceleration of relatively heavy particles such as protons or ions.

FIG. 8 is a schematic illustration of an alternative preferred embodiment of a biperiodic accelerator constructed in accordance with the present invention, which is intended for acceleration of heavier charged particles, such as ions or protons. The accelerator of FIG. 8 is intended to represent a major accelerator and for such accelerators very high power RF sources, on the order of tens of megawatts, are most economical and thus a result in a more complex assembly. The accelerator assembly includes an ion source 40 coupled to a radiofrequency quadrupole (RFQ) 42, which is in turn coupled to a drift tube linac (DTL) 44 powered by one or more tetrodes 46. Tetrode RF sources tend to be more complex and therefore more expensive because tetrodes tend to be lower gain and lower power.

Charged particles emitted from the ion source 40 are initially accelerated by the RFQ 42 and the drift tube linac 44 to a velocity on the order of 0.2 c and are introduced into a series of accelerator tubes, of which three tubes 48, 50 and 52 are shown. Accelerator tubes 48 and 50 may typically have as many as 100 accelerating cavities and the final accelerator tube 52 may have as many as 50 cavities, all of which operate essentially as described above with regard to the electron accelerator. The number of cavities is mostly a matter of mechanical convenience since the output end of each cell is on the order of one foot in length. Representative reflective end cells from opposite ends of the series of accelerator tubes are shown in exaggerated proportion as end cells 54 and 56. The three accelerator tubes are powered by three klystrons 58, 60 and 62. The klystrons as well as the tetrodes are amplifiers which are driven by an RF driver 64, with a frequency multiplier 66 interposed between the RF driver 64 and the klystrons 58 through 62. The enlarged cell 56 is shown as being longer and thinner than cell 54, to illustrate schematically one way to maintain substantially constant resonant frequencies in the cells while also maintaining the standing wave in synchronism with the accelerating particles. Particles emitted from the accelerator may attain velocities on the order of 0.75 c.

As with the electron accelerator of FIG. 4 described above, the cavities of the accelerator shown in FIG. 8 resonate at the same frequency and are connected by resonant coupling slots 68, shown in the enlarged cells 54 and 56 of FIG. 8. The cavities are shaped and sized to maintain a constant resonant frequency, for example by making the cavities near the emission end longer and narrower, while also maintaining the standing wave in synchronism with the positions of the charged particles as they are accelerated along the assembly.

Referring to FIGS. 9 through 13, there is illustrated a another preferred embodiment of the invention, which is referred to here as a triperiodic slot coupled accelerator, with the term "triperiodic" meaning that a complete period consists of three resonators—two cavities and a resonant slot. In this embodiment an accelerator tube 70 includes an outer cylindrical wall 70*a* and two types of interior walls, 70*b* and 70*c*, which in alternate in sequence along the axis of the accelerator. The interior walls 70*b* and 70*c* are shown as being equally spaced from one another so as to form cavities 72 of equal length, although it will be understood that, as with the embodiment described above, the lengths of the cavities 72 may increase progressively along the length of the accelerator to accommodate increasing particle velocities.

Figure 9:
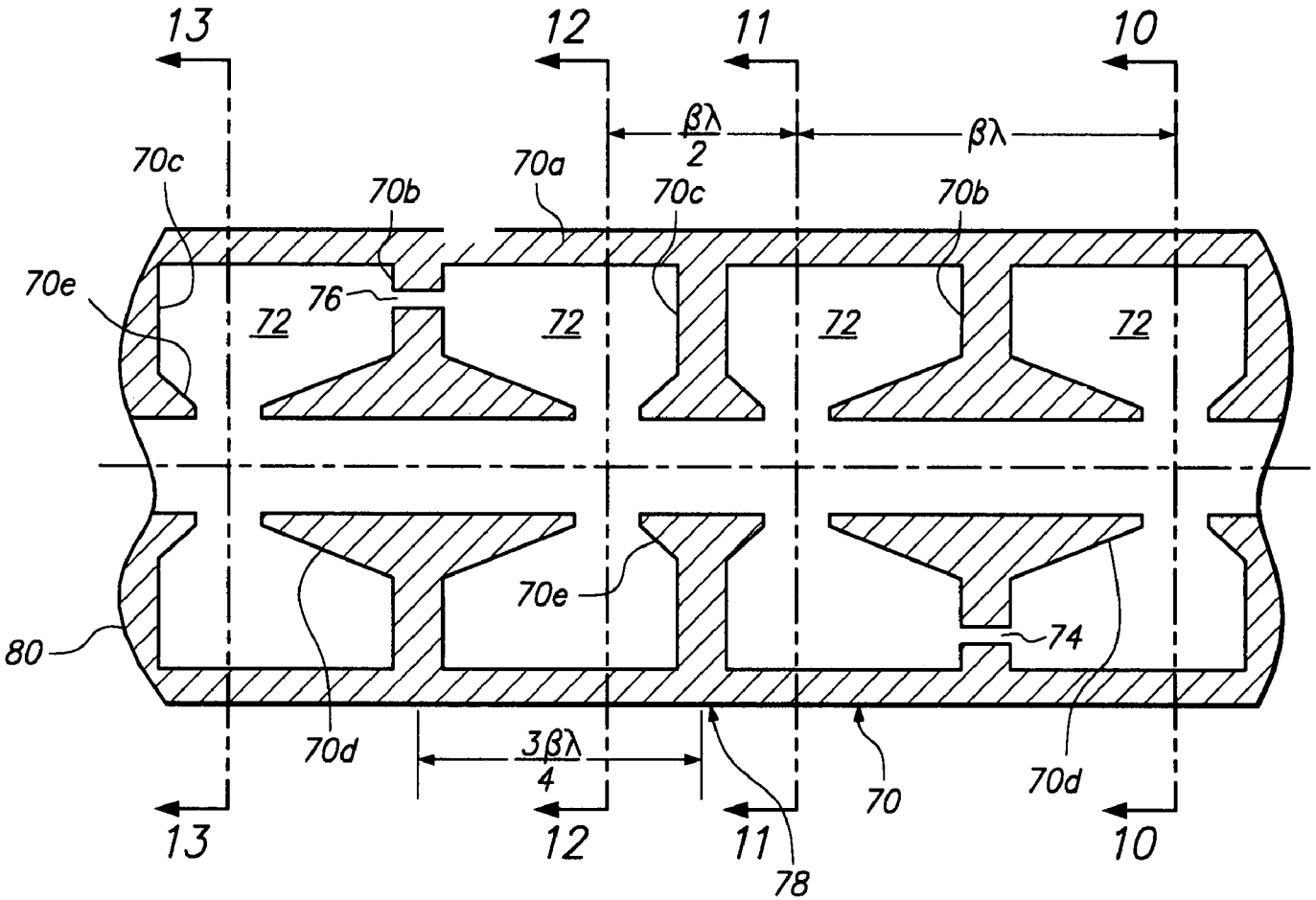
FIG. 9 is schematic side view in cross section of a triperiodic accelerator constructed in accordance with the present invention, and having interior walls with resonant as well as nonresonant slots.
Figure 10:
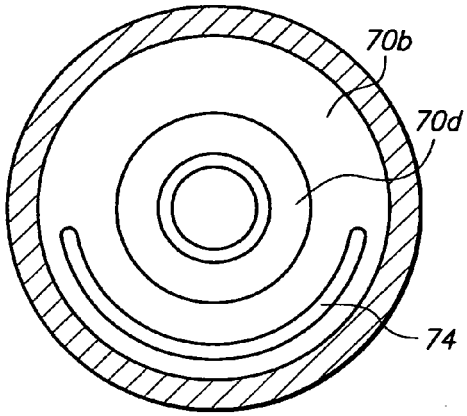
FIGS. 10 through 13 illustrate end views in cross sections taken along corresponding section lines of FIG. 9.
Figure 11:
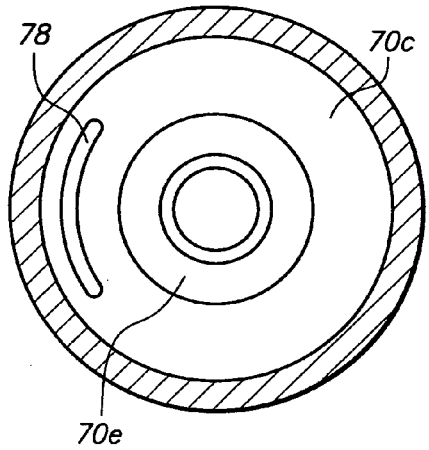
Figure 12:
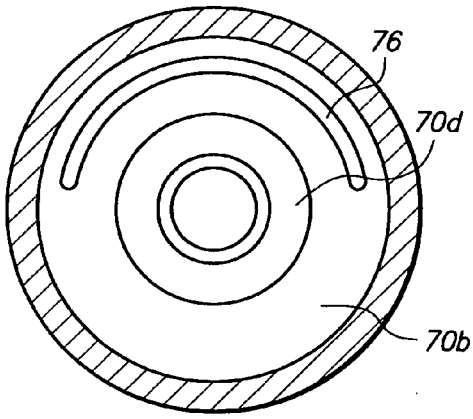
Figure 13:
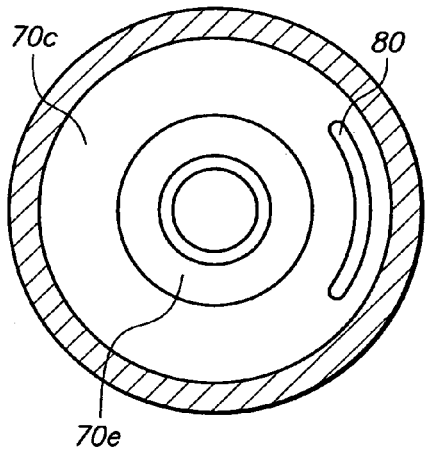

The two types of interior walls 70*b* and 70*c* differ in the lengths of the nose cones that extend in opposite directions from them. Interior walls 70*b* have long nose cones 70*d* extending in each direction, whereas interior walls 70*c* have short nose cones 70*e* extending in each direction. For any particular particle speed, the spacing between adjacent walls 70*b* and 70*c* is equal to the distance $\frac{3}{4}\beta\lambda$. The lengths of nose cones 70*d* and 70*e* are such that the midpoints of the gaps between opposing nose cone tips in the various cavities are spaced apart by alternating distances of 62 $\lambda/2$ and $\beta\lambda$, as shown in FIG. 9. The midpoints between opposing nose cones occur at the locations of section lines 10-10, 11-11, 12-12, and 13-13; which section lines also indicate the cross sections along which the cross-sectional views of FIGS. 10 through 13 are taken.

As a result, it will be seen that the center-to-center distances for the closely spaced ($\beta\lambda/2$) midpoints is one-half the center-to-center distance between the widely spaced ($\beta\lambda$) midpoints. For example, the distance between section lines 11-11 and 12-12 is one half the distance between section lines 10-10 and 11-11.

Referring to FIGS. 10 through 13, the alternating interior walls 70*b* have long, resonant slots 74 and 76, whereas alternating walls 70*c* have short, nonresonant slots 78 and 80. Further, the resonant slots 74 and 76 are offset azimuthally from one another on opposite sides of the longitudinal axis of the accelerator 70; and the nonresonant slots 78 and 80 are likewise offset from one another azimuthally on opposite sides of the longitudinal axis. Further, the resonant slots 74 and 76 are rotated 90 degrees about the longitudinal axis with respect to the nonresonant slots 78 and 80. Thus the resonant slots alternate from top to bottom in the Figures and the nonresonant slots alternate from left to right.

The embodiment of FIGS. 9 through 13 has a higher shunt impedance for high values of $\beta$ and is thus particularly useful for electron accelerators at values of $\beta$ greater than approximately 0.75. The structure is axisymmetric except for the slots and all the interior walls are of the same thickness.

In the triperiodic and higher-order embodiments, it is desirable to maintain field flatness for the operating mode. In the triperiodic case where n=1, one period consists of one "dead" resonant slot and two live cavities, with the two cavities having the same RF field magnitude by symmetry. In this case no special adjustment is necessary to assure that all live cells have the same field strength. However, for n=2 or higher, the cells connected by nonresonant slots will not necessarily oscillate with the same amplitude. This can be corrected by adjusting the coupling strength of the nonresonant slots, and possibly the resonant frequency of the cavities. Achieving the desired coupling may require adding a second nonresonant slot to the walls having nonresonant slots, positioned at a 180 degree azimuthal angle with respect to the first nonresonant slot.

Corresponding embodiments may be constructed with up to four walls having nonresonant slots separating each pair of walls having resonant slots. Depending on the number of walls having nonresonant slots, the accelerator is operated in the $(n+1)\pi/(n+2)$ mode, where n is the ratio of the number of interior walls having nonresonant slots to the number of interior walls having resonant slots.

While the present invention is described herein with reference to certain preferred embodiments, it will be understood that various modifications, substitutions and alterations may be made by one of ordinary skill in the art without departing from the essential invention. Accordingly, the scope of the present invention is defined by the following claims.

The embodiments of the invention in which patent protection is claimed are defined as follows:

1. A slot resonance coupled standing wave particle accelerator comprising:

a hollow accelerator body having an elongate outer wall that is substantially coaxial with a longitudinal axis that defines a beam line, said accelerator body having a pair of transverse end walls at the opposite ends of said outer wall and a plurality of spaced transverse interior walls therebetween, said outer wall and said transverse end and interior walls forming a plurality of accelerator cells positioned in sequence along said axis, including a pair of reflective end cells located at each end of said accelerator body adjacent said end walls, each cell defining a resonant accelerator cavity in which a radiofrequency standing wave is maintained, and wherein said resonant cavities have substantially the same resonant frequency;

an input port opening into at least one of said cells for introducing a high power radiofrequency input signal operable to maintain a standing wave in said accelerator body;

adjacent pairs of said cells each sharing a common interior wall, each interior wall having a resonant slot passing therethrough that connects the resonant cavities on each side of said common interior wall, each resonant slot being offset from said longitudinal axis of said accelerator body and having a major axis extending substantially transverse to the radial direction with respect to said longitudinal axis of said accelerator body, each slot having a resonant frequency comparable to said resonant frequency of said cavities, said slots and said cavities having overlapping passbands such that the frequency of said input signal is selected to drive and maintain the accelerator in a $\pi/2$ mode, such that adjacent cavities are magnetically coupled by said resonant slots in said interior walls and the passband associated with said standing wave is continuous in the vicinity of said $\pi/2$ mode;

each interior wall having a pair of nose cones that extend from opposite sides of said interior wall into the cavities on opposite sides of said interior wall, and each end wall having a single nose cone extending into the cavity adjacent to said end wall, each pair of nose cones extending into a cavity being opposed to one another and terminating in tips which are spaced from one another to form a gap between said tips, said nose cones and said transverse walls having central bores that are aligned to form a beam tube that extends the length of said accelerator body along said beam line and which has an injection end and an emission end, through which charged particles may be introduced, accelerated as they pass through said gaps, and emitted;

said cells being shaped and sized such that the distance between midpoints of said gaps of adjacent cavities is approximately $\beta\lambda$, where $\lambda$ is the free space wavelength of the resonant standing wave in said cavities and $\beta$ is the velocity of a particle passing through said cavity; and wherein said end cells are tuned such that said nodes of said standing wave occur in said slots.

2. The slot resonance coupled standing wave particle accelerator defined in claim 1 wherein said standing wave has a progressively increasing phase velocity toward said emission end and is thereby maintained in synchronism with charged particles as they are accelerated to higher velocities along the length of the accelerator.

3. The slot resonance coupled standing wave particle accelerator defined in claim 2 wherein said slots in adjacent interior walls are positioned on opposite sides of said longitudinal axis from one another, such that said slots are in alternating positions on opposite sides of said axis along the length of the accelerator.

4. The slot resonance coupled standing wave particle accelerator defined in claim 3 wherein each of said slots is semicircular in shape and extends over an azimuthal range of between approximately 120° and 180° about said longitudinal axis.

5. The slot resonance coupled standing wave particle accelerator defined in claim 2 wherein said gaps between said tips of said nose cones are substantially centered longitudinally in said cavities.

6. The slot resonance coupled standing wave particle accelerator defined in claim 5 wherein each of said nose cones has a length of at least approximately $\frac{1}{4}\beta\lambda$ as measured from the center of the wall from which it extends.

7. The slot resonance coupled standing wave particle accelerator defined in claim 6 wherein said nose cones are conical.

8. The slot resonance coupled standing wave particle accelerator defined in claim 2 wherein said transverse walls are spaced at increasing distances from one another toward said emission end of said accelerator, such that said standing wave has a progressively increasing phase velocity toward said emission end of said accelerator and is thereby maintained in synchronism with said charged particles.

9. The slot resonance coupled standing wave particle accelerator defined in claim 8 wherein said cells of said accelerator body are of progressively decreasing diameter toward said emission end so as to maintain a substantially constant resonance frequency in said cavities along the length of the accelerator.

10. The slot resonance coupled standing wave particle accelerator defined in claim 1 wherein said input port opening into at least one of said cells is located near the center of said accelerator body.

11. A slot resonance coupled standing wave particle accelerator comprising:

a hollow accelerator body having an elongate outer wall that is substantially coaxial with a longitudinal axis that defines a beam line, said accelerator body having a pair of transverse end walls at opposite ends of said outer wall and a plurality of spaced transverse interior walls therebetween, said outer wall and said interior walls and said end walls forming a plurality of accelerator cells positioned in sequence along said accelerator body, including a pair of reflective end cells located at each end of said accelerator body adjacent said end walls, each cell defining a resonant cavity in which a radiofrequency standing wave is maintained;

adjacent pairs of cells each sharing a common interior wall, each interior wall having a slot passing therethrough that connects the resonant cavities on each side of said interior wall, each of said slots being offset from said longitudinal axis of said accelerator body and having a major axis extending substantially transverse to the radial direction with respect to said longitudinal axis of said accelerator body;

each interior wall having a pair of nose cones that extend from opposite sides of said interior wall into the cavities on each side of said interior wall, and each end wall having a single nose cone extending into the cavity adjacent to said end wall, such that a pair of nose cones extends into each cavity, each pair of nose cones extending into a cavity being opposed to one another and terminating in tips that are spaced from one another to form a gap between said tips, said nose cones and said transverse walls having central bores that are aligned to form a beam tube that extends the length of said accelerator body and which has an injection end and an emission end, and through which charged particles may be introduced, accelerated as they pass through said cavities, and emitted;

selected ones of said interior walls having a resonant slot having a resonant frequency comparable to said resonant frequency of said cavities, such that passbands associated with said cavities and said resonant slots overlap, and selected other interior walls having at least one shorter nonresonant slot that resonates at a frequency on the order of twice the resonant frequency of said cavities, such that between each pair of interior walls having said resonant slots there are n interior walls each having said nonresonant slots, where n=1 to 4, and wherein the midpoints between opposing nose cones in cavities connected by a resonant slot are spaced by a distance of $\beta\lambda$ and the midpoints between opposing nose cones in cavities connected by nonresonant slots are spaced by a distance of $\beta\lambda/2$;

an input port opening into one of said cells for introducing a high power radiofrequency input signal at a frequency operable to maintain a standing wave in said accelerator body and to drive and maintain said standing wave in a $(n+1)\pi/(n+2)$ mode;

wherein the lengths of said nonresonant slots and the resonant frequencies of cavities located between walls having nonresonant slots are selected to obtain substantially equal accelerating electric field magnitudes in said cavities, and the length of said resonant slots is selected so that the dispersion curve for a periodic sequence of groups of (n+1) cavities is continuous and has a non-zero slope in the vicinity of the $(n+1)\pi/(n+2)$ operating point; and wherein said end cells are tuned such that said nodes of said standing wave occur in said slots.

12. The slot resonance coupled standing wave particle accelerator defined in claim 11 wherein said standing wave has a progressively increasing phase velocity toward said emission end of said accelerator and is thereby maintained in synchronism with charged particles as they are accelerated along the length of the accelerator.

13. The slot resonance coupled standing wave particle accelerator defined in claim 12 wherein n=1 and wherein said slots in adjacent interior walls are rotated by 90° with respect to one another about said longitudinal axis, such that successive resonant slots are in alternating positions on opposite sides of said axis form one another along the length of the accelerator, and such that said nonresonant slots are also in alternating positions on opposite sides of said axis form one another along the length of the accelerator.

14. The slot resonance coupled standing wave particle accelerator defined in claim 13 wherein each of said resonant slots is semicircular in shape and extends over an azimuthal range of between approximately 120° and 180° about said longitudinal axis.

15. The slot resonance coupled standing wave particle accelerator defined in claim 12 wherein said transverse walls are spaced at increasing distances from one another toward said emission end of said accelerator, such that said standing wave has a progressively increasing phase velocity toward said emission end of said accelerator and is thereby maintained in synchronism with said charged particles.

16. The slot resonance coupled standing wave particle accelerator defined in claim 15 wherein said accelerator body is tapered to a smaller diameter toward said emission end to maintain an essentially constant resonant frequency in said cavities.

17. The slot resonance coupled standing wave particle accelerator defined in claim 11 wherein said input port opening into one of said cells is located near the center of said accelerator body.

* * * * *